US005304067A

United States Patent [19]

Inaba et al.

[11] Patent Number: 5,304,067

[45] Date of Patent: Apr. 19, 1994

[54] SHIELDED CONNECTOR

[75] Inventors: Shigemitsu Inaba; Toru Nagano; Satoshi Yamada; Hiroki Kondo, all of Shizuoka, Japan

[73] Assignee: Yazaki Corporation, Tokyo, Japan

[21] Appl. No.: 928,777

[22] Filed: Aug. 13, 1992

[30] Foreign Application Priority Data

Sep. 13, 1991 [JP] Japan ..... 3-073979[U]

[51] Int. Cl.[5] ..... H01R 13/648; H01R 658

[52] U.S. Cl. ..... 439/98; 439/97; 439/610

[58] Field of Search ..... 439/95, 97, 98, 610

[56] References Cited

U.S. PATENT DOCUMENTS 3,015,794 1/1962 Kishbaugh ..... 439/95
3,382,355 5/1968 Prifogle et al. ..... 439/95
4,738,638 4/1988 Bogese II ..... 439/610
4,793,059 12/1988 Moreau et al. ..... 439/97
4,810,210 3/1989 Komatsu ..... 439/610
4,854,895 8/1989 Komatsu ..... 439/610

FOREIGN PATENT DOCUMENTS 63-127083 8/1988 Japan .

*Primary Examiner*—Gary F. Paumen
*Attorney, Agent, or Firm*—Armstrong, Westerman, Hattori, McLeland & Naughton

[57] ABSTRACT

A shielded connector is provided which directly grounds harmful noise in the connector to the mounting body at the same time that the connector is mounted to the body. A metal shell is interposed between the insulating inner housing accommodating a terminal and the insulating outer housing accommodating the inner housing. The metal shell is provided with a metal clamp for grounding which projects outwardly from the outer housing to be directly fixed to a grounding body by a bolt.

13 Claims, 4 Drawing Sheets

SHIELDED CONNECTOR

BACKGROUND OF THE INVENTION

1. Field of the Invention

This invention relates to a shielded connector that is grounded to a car body when assembled to the body to protect the connector from harmful noise.

2. Description of the Prior Art

FIG. 6 shows a vertical cross section of a conventional shielded connector introduced in the Japanese Utility Model Preliminary Publication No. Showa 63-127083.

The figure shows only one shielded connector 32, in which reference numeral 33 represents an insulating cover made of synthetic resin, 34 a cylindrical metallic shell as a shielding member assembled inside the cover 33, 35 a housing body of synthetic resin installed inside the metallic shell 34 and accommodating a plurality of terminals 36; and 37 a shielded cable connected to the terminals and having its braided shield 38 connected to the metal shell 34.

In the other shielded connector not shown, the metallic shell has an earth terminal projecting therefrom (not shown). When both connectors are coupled together to connect the earth terminal to the printed circuit card (not shown), harmful noise is grounded through the earth circuit (not shown).

In other words, the above described shielded connector is similar to a construction shown in FIG. 7, in which the connector portion 32' is engaged with the mating connector portion 39' and harmful noise generated by the connector portions 32', 39' is grounded through the metal shell and shielded cables 37', 40' as shown by arrow B.

Therefore when the circuit connecting the earth terminal or the shielded wires 37', 40' for the earth are long, the earthing distances from the connector portions 32', 39' become long, thus deteriorating the shielding performance.

SUMMARY OF THE INVENTION

This invention has been accomplished to overcome the above drawback and its object is to provide a shielded connector that can improve the connector's shielding performance.

To achieve the above objective, the construction of the invention is characterized in that a metallic shell is interposed between an insulating inner housing which accommodates terminals and an insulating outer housing which accommodates the inner housing; and that the metal shell is provided with a metal clamp for grounding that projects outwardly from the outer housing and which is directly fixed to the earth body by fastening means such as a bolt. It is also characterized in that the opening in the outer housing through which the metal clamp projects is filled with a sealing material for waterproofing.

The metal clamp provided to the metal shell is secured to the earth body by fastening means, such as bolts so that it is connected to the ground at the same time, directly grounding the noise generated by the connector to the body. This improves the shielding performance of the connector. Further, the waterproofing ability given to this connector permits it to be mounted to the car body.

DETAILED DESCRIPTION OF PREFERRED EMBODIMENT

Figure 1:
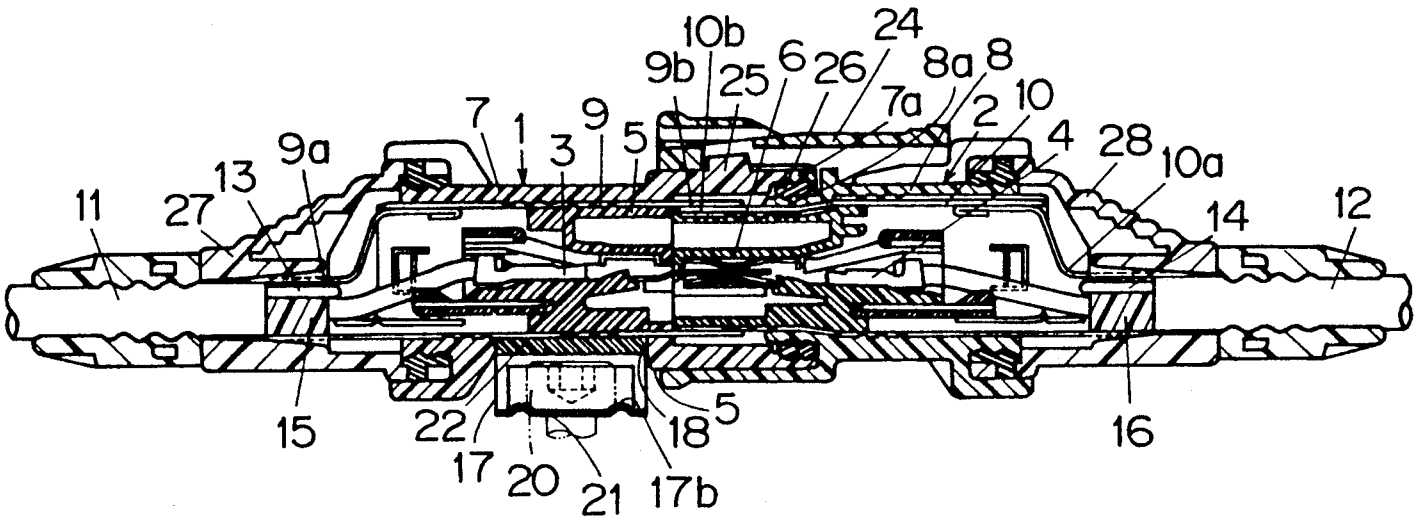
FIG. 1 is a vertical cross section of a shielded connector as one embodiment of this invention (in an engaged state)
Figure 2:
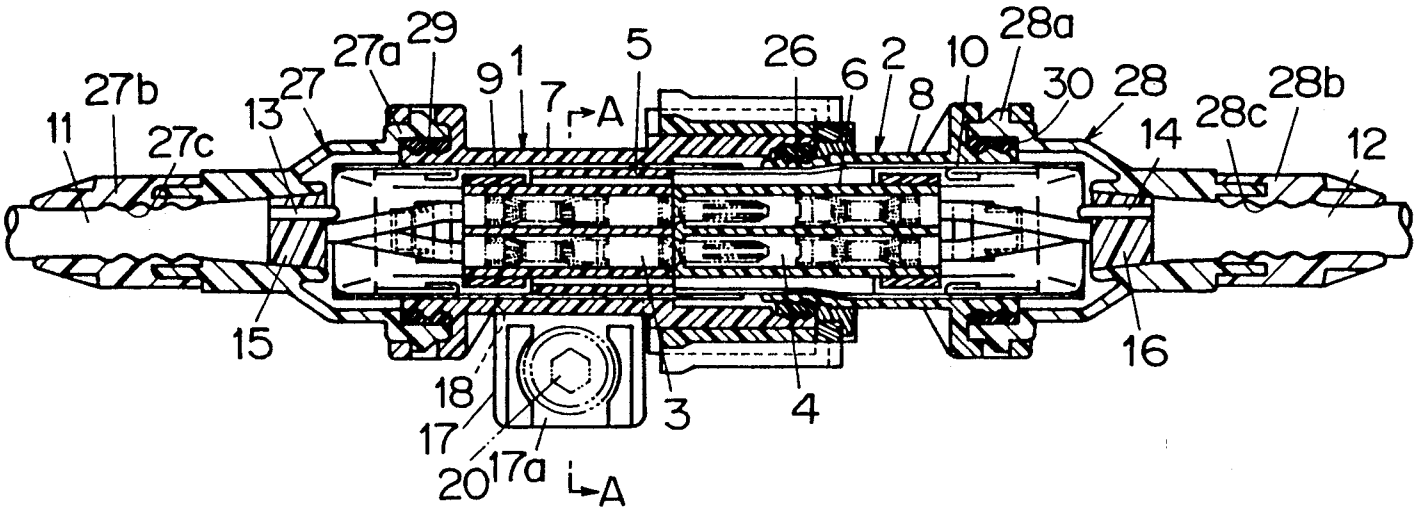
FIG. 2 is a horizontal cross section of the shielded connector of FIG. 1.

FIG. 1 is a vertical cross section of the shielded connector as one embodiment of the invention. FIG. 2 is a horizontal cross section of the same.

In the figures, a pair of left and right connector portions 1, 2 are shown engaged and consist of: cylindrical inner housings 5, 6 of insulating synthetic resin that accommodate terminals 3, 4; cylindrical outer housings 7, 8 of insulating synthetic resin that accommodate the inner housings 5, 6; conductive metal shells 9, 10 for shielding securely interposed between the inner housings 5, 6 and the outer housings 7, 8.

Figure 6:
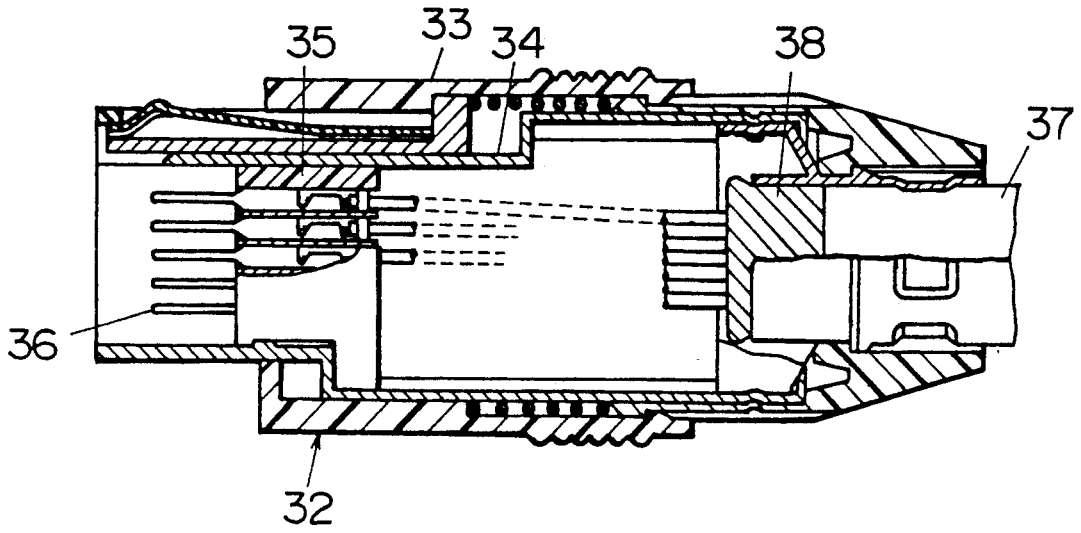
FIG. 6 PRIOR ART
FIG. 6 is a vertical cross section of a conventional shielded connector.
Figure 7:
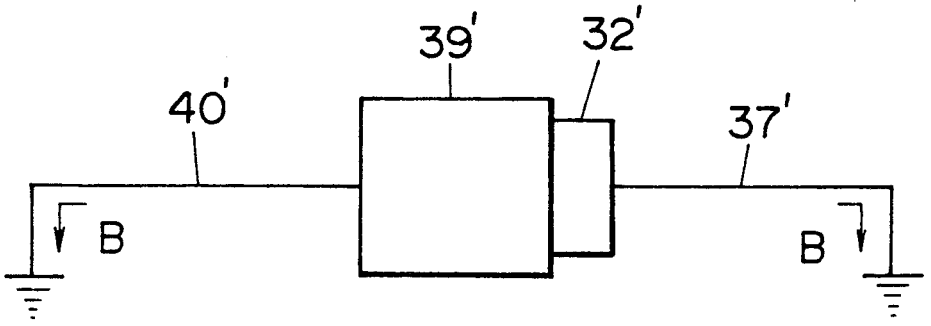
FIG. 7 PRIOR ART
FIG. 7 is a conventional earth connection diagram.

The terminals 3, 4 are connected with cables 11, 12 whose base portions have exposed drain wires 13, 14 for earthing, to which end portions 9*a*, 10*a* of the metal shells 9, 10 are connected by being wound with conductive tapes 15, 16. The drain wires 13, 14 and the conductive tapes 15, 16 may be replaced with the braided shield (38 of FIG. 6) used in the conventional example.

Figure 3:
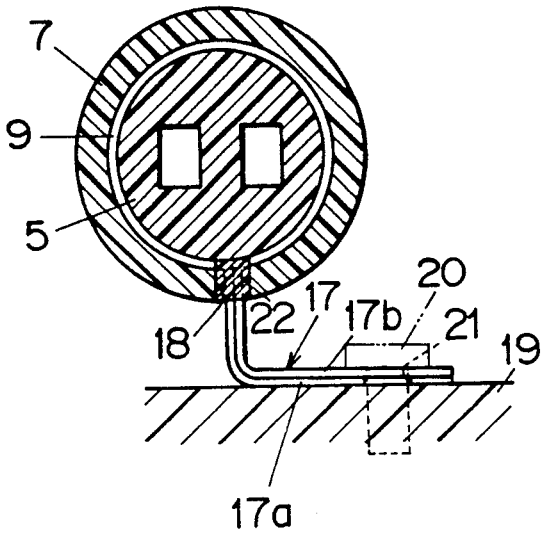
FIG. 3 is a cross section taken along the line A—A of FIG. 2.

The fuselage portion of the metal shell 9 in one connector portion 1 is formed integrally with or joined as a separate member with a metal clamp 17. As shown in FIG. 3, the A—A cross section of FIG. 2, the metal clamp projects outwardly from an opening 18 in the circumferential portion of the outer housing 7 and has an L-shaped mounting/connecting portion 17*a* for the stationary earth body 19.

FIG. 3 shows the metal clamp 17 formed integrally with the metal shell 9. The mounting/connecting portion 17*a* has reinforcing ribs 17*b* formed on both sides and an insertion hole 21 formed at the center for the bolt 20 as a connecting means. The opening 18 in the circumferential portion of the outer housing 7 is filled with a waterproofing epoxy resin 22.

Figure 4:
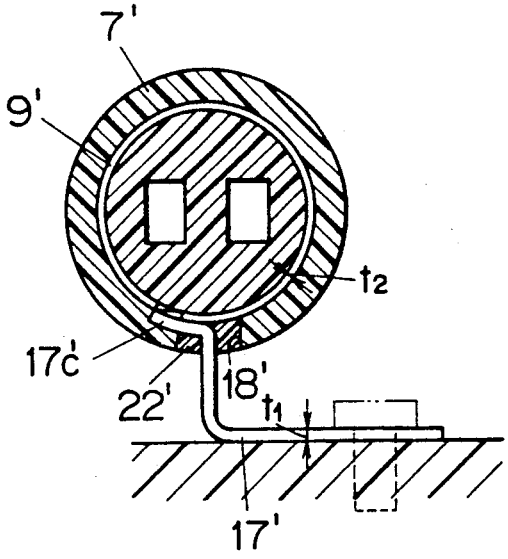
FIG. 4 is a cross section taken along the line A—A showing a similar example.

FIG. 4 shows another example in which the metal clamp 17' is provided separate from the metal shell 9'. The metal clamp 17' has a joint terminal 17*c'* that is curved along the circumferential portion of the metal shell 9', with the thickness $t_1$ of the metal clamp 17' set larger than the thickness $t_2$ of the metal shell 9' to increase the strength of the clamp. The opening 18' in the circumferential portion of the outer housing 7' is filled with a waterproofing epoxy resin 22' as in the preceding embodiment. The epoxy resin 22' also serves to securely fix the metal clamp 17'.

Figure 5:
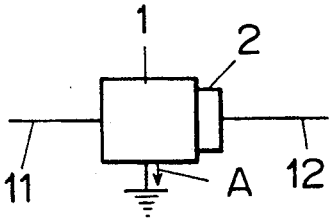
FIG. 5 is a diagram showing the earth connection of the shielded connector of the invention.

As shown in FIG. 5, the metal clamp 17 or 17' leads the noise in the connector portion 1, 2 to the ground as indicated by arrow A.

In FIGS. 1 and 2, the left and right metal shells 9, 10 are connected together, with their front portions 9*b*, 10*b* overlapped and the outer housings 7, 8 are connected together, with a flexible locking arm 24 engaged with a locking projection 25. A waterproofing packing 26 is installed between the joint portions 7*a* and 8*a* of the outer housing 7, 8.

Denoted 27 and 28 are rear covers made of insulating synthetic resin and rubber that interconnect the outer housings 7, 8 and the cables 11, 12. Waterproof packings 29, 30 are installed between the joint portions 27*a*, 28*a* of the rear covers 27, 28 and the outer housings 7, 8. The joint portions 27*b*, 28*b* of the rear covers 27, 28 on the shield wire side are provided with circular projecting strips 27*c*, 28*c* to form a waterproof shield connector.

As mentioned above, this invention has the following features and advantages. Since the metal clamp provided to the metal shell which is fixed to the car body by a fastening means such as a bolt also serves as a grounding circuit for directly grounding the noise in the connector portion into the car body, the shielding performance of the connector portion is improved over the conventional construction in which the noise is grounded through the separate grounding circuit or the cable. Further, the conventional shielded connector can only be installed in a cabin where printed circuit cards are used, whereas the connector of this invention has a waterproofing capability and therefore can be mounted to a car body. Moreover, since the connector portion is fixed by the metal clamp, the structure of the shielded connector of the invention has a strong anti-seismic strength.

What is claimed is:

1. A shielded connector comprising:

an insulating inner housing accommodating a terminal;

an insulating outer housing accommodating the inner housing;

a metal shell for shielding, interposed between the inner housing and the outer housing, the outer housing extending substantially over an entire length of the metal shell; and a metal clamp for grounding, connected to the metal shell, a portion of the metal clamp extending radially outwardly from the outer housing, the metal clamp for fixing to a grounding body by a fastening means such that the metal clamp directly supports the connector in position, and wherein an opening is formed in the outer housing through which the metal clamp projects, and is filled with a waterproof sealing material.

2. A shielded connector as claimed in claim 1, wherein said insulating inner and outer housings are made of synthetic resin.

3. A shielded connector as claimed in claim 1, further comprising a cable connected to said terminal.

4. A shielded connector as claimed in claim 3, wherein said cable comprises a base portion having an exposed drain wire for grounding, said drain wire being connected to an end portion of said metal shell.

5. A shielded connector as claimed in claim 4, further comprising conductive tape wound around said end portion of said metal shell and said base portion of said cable.

6. A shielded connector as claimed in claim 1, wherein said metal clamp is formed integrally with said metal shell.

7. A shielded connector as claimed in claim 1, wherein said water-proof sealing material is an epoxy resin.

8. A shielded connector as claimed in claim 3, further comprising a rear cover interconnecting said outer housing and said shielded wire.

9. A shielded connector as claimed in claim 8, further comprising waterproof packing installed between said rear cover and said outer housing.

10. A shielded connector as claimed in claim 8, wherein said rear cover is made of insulating synthetic resin and rubber.

11. A shielded connector as claimed in claim 1, wherein said inner and outer housings and said metal shell are substantially cylindrical and each have a circumference, radius and axis, said metal clamp being substantially L-shaped having a first portion connected to said metal shell and extending from said metal shell in said radial direction, and a second portion extending perpendicularly to said first portion.

12. A shielded connector as claimed in claim 11, wherein said first portion of said metal clamp comprises a circumferential portion which extends adjacent and circumferentially along said metal shell.

13. A shielded connector as claimed in claim 1, wherein said metal clamp has a thickness $t_1$ greater than a thickness $t_2$ of said metal shell.

* * * * *